US010625755B2

(12) United States Patent
Thoni

(10) Patent No.: US 10,625,755 B2
(45) Date of Patent: Apr. 21, 2020

(54) CROSS MEMBER FOR RAIL VEHICLES, USED FOR ARTICULATING A RAIL VEHICLE BODY TO THE BOGIE THEREOF

(71) Applicant: Lothar Thoni, Jakobsbad (CH)

(72) Inventor: Lothar Thoni, Jakobsbad (CH)

( * ) Notice: Subject to any disclaimer, the term of this patent is extended or adjusted under 35 U.S.C. 154(b) by 414 days.

(21) Appl. No.: 15/527,627

(22) PCT Filed: Nov. 17, 2015

(86) PCT No.: PCT/EP2015/076766
§ 371 (c)(1),
(2) Date: Aug. 21, 2017

(87) PCT Pub. No.: WO2016/079090
PCT Pub. Date: May 26, 2016

(65) Prior Publication Data

US 2018/0141572 A1 May 24, 2018

(30) Foreign Application Priority Data

Nov. 21, 2014 (DE) ..... 10 2014 117 047

(51) Int. Cl.
*B61F 1/12* (2006.01)
*B61F 5/24* (2006.01)
*B61F 5/52* (2006.01)

(52) U.S. Cl.
CPC ..... *B61F 1/12* (2013.01); *B61F 5/24* (2013.01); *B61F 5/52* (2013.01)

(58) Field of Classification Search
CPC ..... B61F 1/00; B61F 1/02; B61F 1/04; B61F 1/06; B61F 1/12; B61F 1/14
See application file for complete search history.

(56) References Cited

U.S. PATENT DOCUMENTS 763,278 A 6/1904 Green
1,114,209 A * 10/1914 Westlake ..... B61F 1/12 105/228
2002/0158381 A1* 10/2002 Foerster ..... B60G 17/01933 267/64.23

FOREIGN PATENT DOCUMENTS

DE 19751742 C2 11/1999
DE 19826448 C2 7/2001
DE 102012105310 A1 12/2013
EP 0775621 5/1997

* cited by examiner

*Primary Examiner* — Robert J McCarry, Jr.
(74) *Attorney, Agent, or Firm* — McHale & Slavin, P.A.

(57) ABSTRACT

The invention relates to a cross member for articulating a body of a rail vehicle to the bogie thereof; the upper face of the cross member is connected to the body, and a bogie pin-supporting plate comprising a bogie pin is secured to the lower face of the cross member with the aid of fastening means, the bogie pin being movably mounted in a bogie pin receptacle on the bogie in order to transmit pulling and braking forces.

20 Claims, 5 Drawing Sheets

CROSS MEMBER FOR RAIL VEHICLES, USED FOR ARTICULATING A RAIL VEHICLE BODY TO THE BOGIE THEREOF

CROSS REFERENCE TO RELATED APPLICATIONS

This is a national stage filing in accordance with 35 U.S.C. § 371 of PCT/EP2015/076766, filed Nov. 17, 2015, which claims the benefit of the priority of German Patent Application No. 102014117047.7, filed Nov. 21, 2014, the contents of each are incorporated herein by reference.

Cross member for rail vehicles for linking of a rail carriage body to its bogie

TECHNICAL AREA

The invention relates to a cross member for a rail vehicle according to the respective generic term of claims 1, 12, 15 and 18.

STATE OF THE ART

Rail vehicles in the sense of the present invention are both rail-bound vehicles with and without their own drive. The special feature of such vehicles is their rail-bound control through the track, which when driving along curves entails relative movements of the landing gear to the carriage body due to the length of the rail vehicles. Simultaneously during a journey, rolling and snaking movements as well as braking and traction forces occur between chassis and carriage body, which require special structural measures in the connection area between chassis and carriage body.

Rail vehicles known for this purpose have, as a supporting component, a cross member made of aluminium casting mounted on the lower side of the carriage body or the box undercarriage, which is hinged to a chassis designed as a bogie. The connection is made via a steel pivot pin, which is fastened centrally to the underside of the cross member by means of a pivot plate which is likewise made of steel and is hinged to the bogie for force transmission in a pivot pin socket mount. The weight of the carriage body is thereby supported by springs disposed between the bogie and the carriage body.

This type of linking enables, on the one hand, a secure transmission of braking and traction forces, while on the other hand, the rotary and rolling movements of the carriage body caused by the driving operation are permitted against the bogie but these are limited for reasons of driving safety and comfort. For this purpose, it is known to counteract the rolling movements by means of a roll damping between the bogie and the cross member and the rolling motion by means of a roll damping between the bogie and the cross member.

Known cross members are cast from suitable aluminium alloys. They are designed as a pressure-resistant hollow body and have the shape of a plate with essentially flat tops and bottoms, on which all necessary structural elements for the connection of the carriage body to the bogie are mounted. The cavity inside the cross member is used as additional air reserve for air suspension. In known cross members, a distinction is made between head cross members, which are provided on the first and last bogie of a train formed by a plurality of rail vehicles, and base cross members, which are arranged at bogies lying in between. The present invention relates to both head cross members and base cross members.

In the case of known rail vehicles, the securing of pivot pin to the cross member has proved to be problematic. Due to the integration of the pivot pin into a pivot pin plate with side stops arranged on the side of the pivot pin, different thermal expansions occur due to the different material-specific coefficients of thermal expansion of steel and aluminium in case of large temperature fluctuations, which produce high shearing forces, especially in the contact surface between the cross member and the pivot pin plate. The fastening means, which are located in the edge region of the pivot plate are thus subjected to extreme loads at great temperature differences, which has already led to a failure of the fastening means for the pivot plate.

A further problem of the known cross members relates to the linking of the roll dampers and winder dampers to the cross member. On the underside of a cross member in the region of the transverse sides, winder damper brackets are screwed, the free ends of which support winder damper head each for linking a winder damper. Due to the geometrical conditions, forces from the winder damper generate high torques in the fastening region of the bracket, which must be absorbed by the screws there and must be taken into account by corresponding dimensioning.

The roll dampers are retained, via a roll bearing rod, at the roll bearings arranged on both sides to the cross-member transverse sides. Known roll bearings consist of an attachment cast on the cross member with a first bearing surface for including the roll bearing rod and a bearing shell with a second bearing surface. To form the roll bearing, the bearing shell is screwed to the attachment, whereby the joining surface extends approximately parallel to the plane of the cross member. The forces which are introduced into the roll bearing via the roll bearing rod from the roll damper lead to very high material stresses in the connection area of the attachment to the cross member, which requires suitable structural measures.

In the case of air-cushioned mounting of the carriage body, the air volume required for the suspension in known rail vehicles is set by the cross member designed as pressure vessel and by the cavity of the rubber-bellows-shaped air springs between the bogie and the cross member. It has been found that the size of the total air volume has a decisive influence on driving safety and driving comfort.

A rail vehicle is described in DE 10 2012 105 310 A1, in which a spring device is provided with a first and second contact element, which comprises a spring unit and is arranged kinematically in series between the carriage body and the running gear unit. DE 198 26 448 C2 also describes a running gear for a rail vehicle, in which the driven pair of wheels is mounted about a common vertical axis and the non-driven individual wheels are pivoted about their own vertical axis respectively; and in which the non-driven individual wheels are coupled with one another using a steering mechanism for a common equilibrium swivelling about their vertical axes. DE 197 51 742 C2 describes a rail vehicle, in which the linking devices are designed in such a way that the drive after exceeding the traction, braking and guide forces which are to be transmitted operationally by the linking device, makes contact at the main frame or frame-tight stops with the interposition of energy-absorbing end-stop elements. However, in terms of driving safety and driving comfort, these cross members can still be improved upon, particularly with regard to their use in areas with high temperature fluctuations.

DESCRIPTION OF THE INVENTION

Against this background, the object of the invention is to further improve known cross members, in particular with regard to their influence on driving safety and driving comfort of rail vehicles equipped therewith, as well as their use in areas with large temperature fluctuations. This object is achieved by means of a cross member having the features of patent claims 1, 12, 15 and 18.

Preferred embodiments are derived from dependent claims.

A first basic idea of the invention is manifested in the concentration of the load-bearing connecting and fastening elements in the narrower circumference region around the axis of the pivot pin. In doing so, thermal expansions between the fastening points as a result of temperature differences have only a small effect such that these can be trapped with tolerances. Rail vehicles with cross members according to the invention are, therefore, usable in areas with large temperature fluctuations of, for example, 50° to −55°.

In a preferred embodiment of the invention, it is provided to assign different load-bearing means to the different stresses acting simultaneously on the connecting area. Thus, braking and pulling forces are removed by a form-fit in the area of the joining surfaces between the pivot plate and the cross member, with the advantage that material stresses are limited by the enlarged force transmission surfaces despite the concentrated load transmission in the pivot post axis. On the other hand, forces from lifting and lowering movements are absorbed in the pivot axis by means of tensioning screws, which are grouped at a narrow radial distance about the axis of the pivot pin. Advantageously, the radial spacing of the clamping screw axes relative to the pivot axis is an optimum distance, which stems from the results of the FEM-calculations. In the present exemplary embodiment, this distance amounts to maximum 80 mm. In a preferred manner, the tensioning screws are arranged within the cross-section of the form-locking means, in order to keep the restraints due to different thermal expansion as low as possible.

In the case of such a connection of the pivot plate to the cross member, tensioning screws are only axially stressed, while bending stresses and shear forces are absorbed via the form-fit. The clamping force of the tensioning screws can, therefore, be used to the maximum extent.

The tensioning screws are advantageously anchored via an abutment plate, on which the screw heads are supported. In this way, point load concentrations on the cross member are avoided in the area of the screw heads. The abutment plate distributes these point loads over the entire contact surface on the cross member.

In the case of an exceptionally high load on the connecting region, for example in the case of an impact or accident, an embodiment of the invention is preferred, in which the pivot plate is additionally supported on the side of the pivot pin on the underside of the cross member. Due to geometric conditions, an improved leverage effect takes place in such a load case, whereby it is possible to absorb even acceleration forces in an order of magnitude of five times the acceleration force.

In the case of such a lateral support, the pivot plate remains functional even at high temperature fluctuations, in a further embodiment of the invention, the lateral support is provided in the mounting areas floating on the underside of the cross member. A preferred embodiment of the invention provides for the use of spacer bushings, which are arranged in oblong holes on the pivot plate and below the intermediate connection of a sliding layer into the pivot plate and are penetrated by fastening screws which, in turn, engage in the underside of the cross member.

An additional fixing of the pivot plate against a displacement in the longitudinal axis of the cross member is effected according to a preferred embodiment of the invention by the arrangement of skirting boards along the longer sides of the pivot plate. Advantageously, the skirting boards are cast on the underside of the cross member and pass monolithically into the side stops, so that the pivot plate made of steel can be kept as small as possible, with the further advantage of reducing the weight compared to known cross members.

A further basic idea of the invention is to embed function components, such as, for example, the winder damper bracket or the side stops, which are screwed onto the flat underside of the cross member in the case of known cross members, from now on monolithically to the cross member. This initially has the considerable advantage that, when designing the winder damper bracket and/or the side stops as hollow bodies, whose cavity supplements the air volume provided by the cross member for the air suspension, which positively affects the driving safety and the driving comfort of a rail vehicle.

With regard to the connection of the winder damper bracket to the cross member, it is also preferred that fasteners, which were subjected to high stress in known cross members due to unfavourable lever ratios, are now no longer necessary because of the monolithic design.

A further basic idea of the invention relates to the roll bearings, the known cross-members of which have a two-part design with horizontal separation to extremely high material stresses in the transition region of the roll bearing to the cross member. As a result of the path of the joining surfaces according to the invention transverse to the plane of the lower or upper cross member side, an enlarged cross-section for the load introduction of the bearing forces into the cross member is provided in an astonishingly simple way, with the result that stress peaks in this area are significantly reduced.

Finally, a further basic concept is contained in a cross member according to the invention, correspondingly the cast contours in the regions between the bearing surfaces, the pivot post plate and the embed anti-rolling damping brackets are designed at a higher level than the bearing surfaces. For example, the level difference between the bearing surfaces and the raised regions can be 30 mm and more, preferably 50 mm and more. This leads initially to the fact that the increased overall height of the cross-member forces can be better absorbed and derived due to greater internal lever action. This allows the design of cross members with significantly lower wall thickness, which in turn is advantageous when the cross member is cast, since the finished aluminium casting has a finer grain structure and is, therefore, characterized by a better material quality.

Since the surface contours are also marked on the inner side of the cross member, which delimits the cavity, an additional air volume for the air suspension is provided with the raised areas, which, as described, brings about driving safety and the driving comfort of a rail vehicle equipped with a cross member according to the invention. At the same time, the raised areas on the underside of the cross member form a border for the seat of the air springs and thus provide improved support and secure seating of the air springs on the cross member. The invention is explained in detail below with reference to an exemplary embodiment shown in FIGS. 1 to 10, wherein further features and advantages of the invention will become apparent without, however, limiting the invention thereto.

Figure 1:
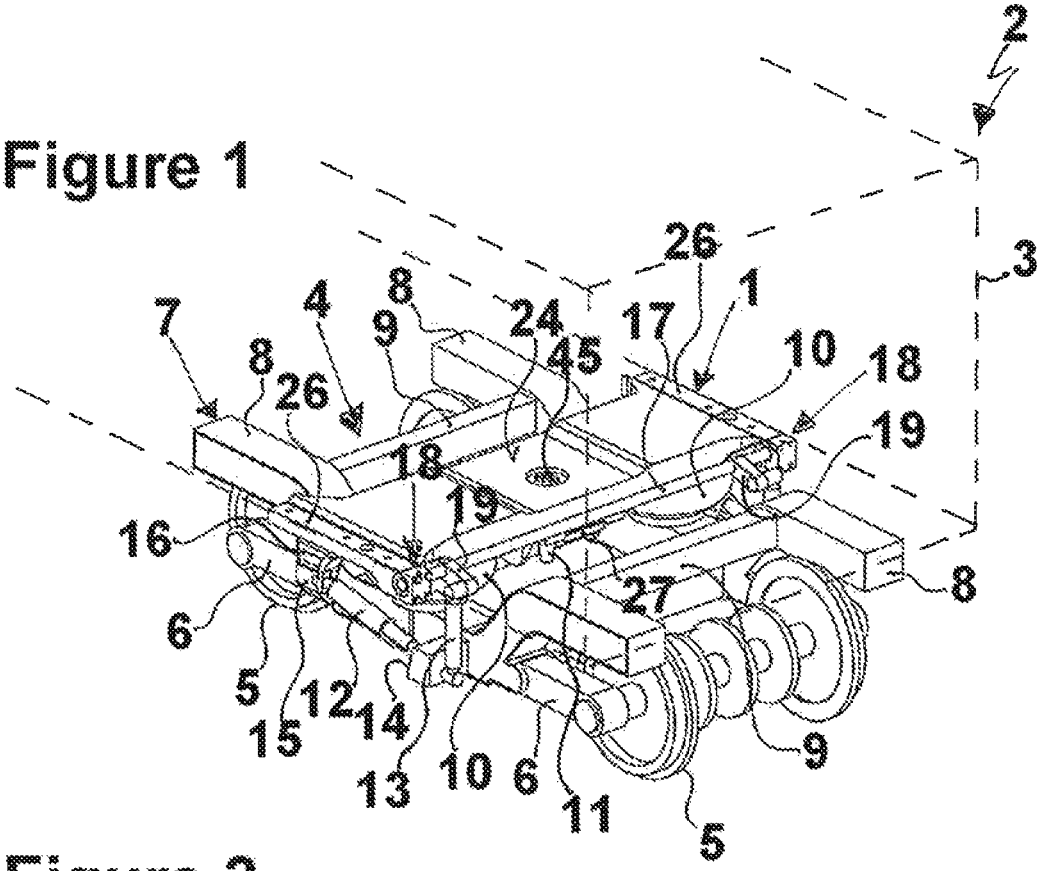
FIG. 1 shows an oblique view of the end of a rail vehicle equipped with a cross member according to the invention in the region of the bogie with the carriage body as indicated.
Figure 2:
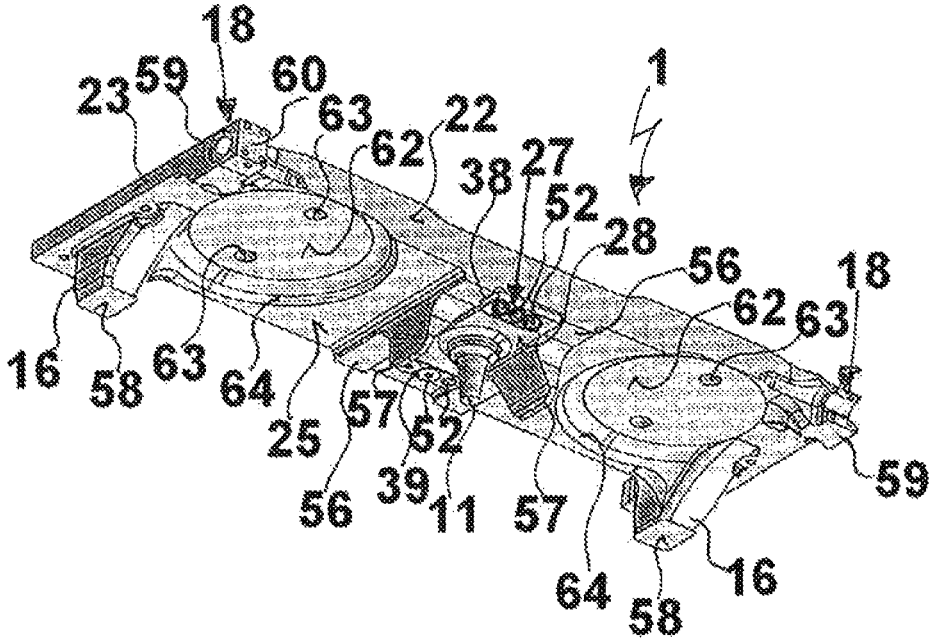
FIG. 2 shows an oblique view of the underside of a cross member according to the invention.
Figure 3:
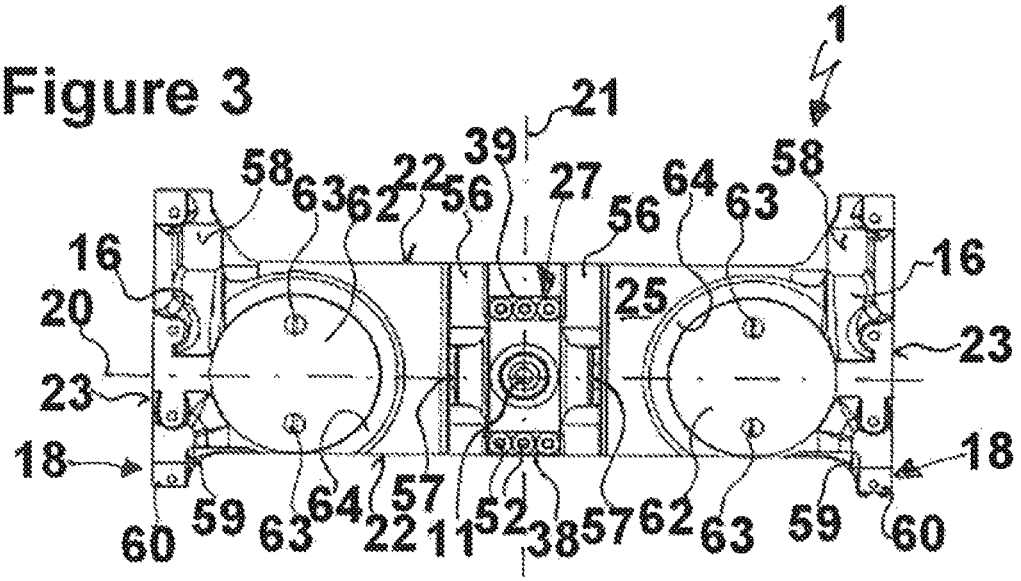
FIG. 3 shows a bottom view of the cross member as shown in FIG. 2.
Figure 4:
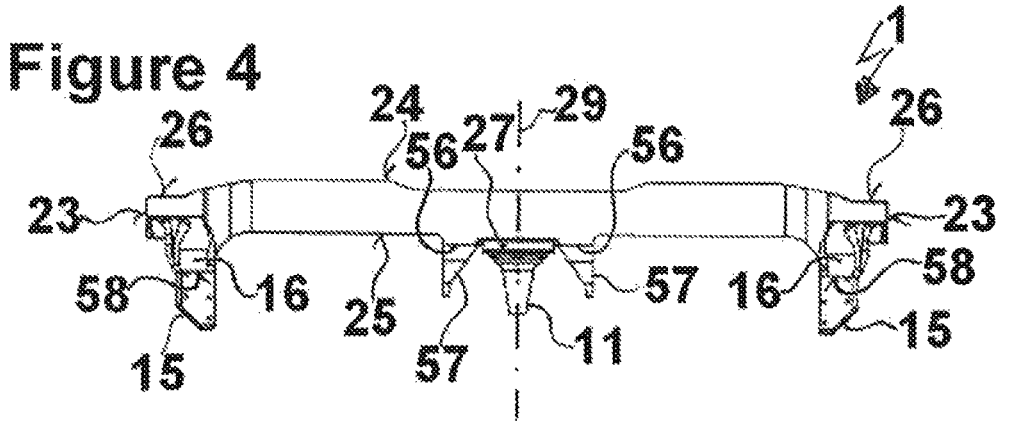
FIG. 4 shows a front view of the cross member as shown in FIG. 2.
Figure 5:
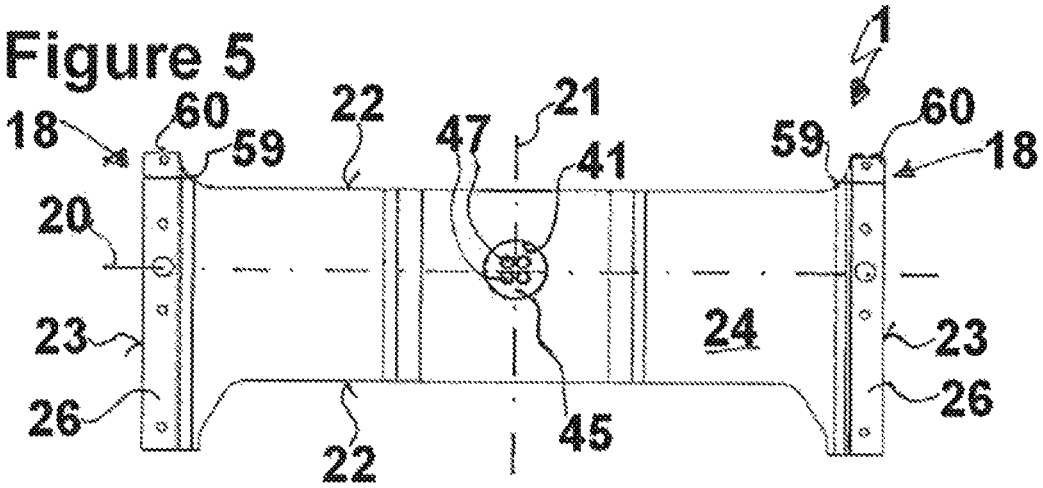
FIG. 5 shows a plan view of the cross member as shown in FIG. 2.
Figure 6:
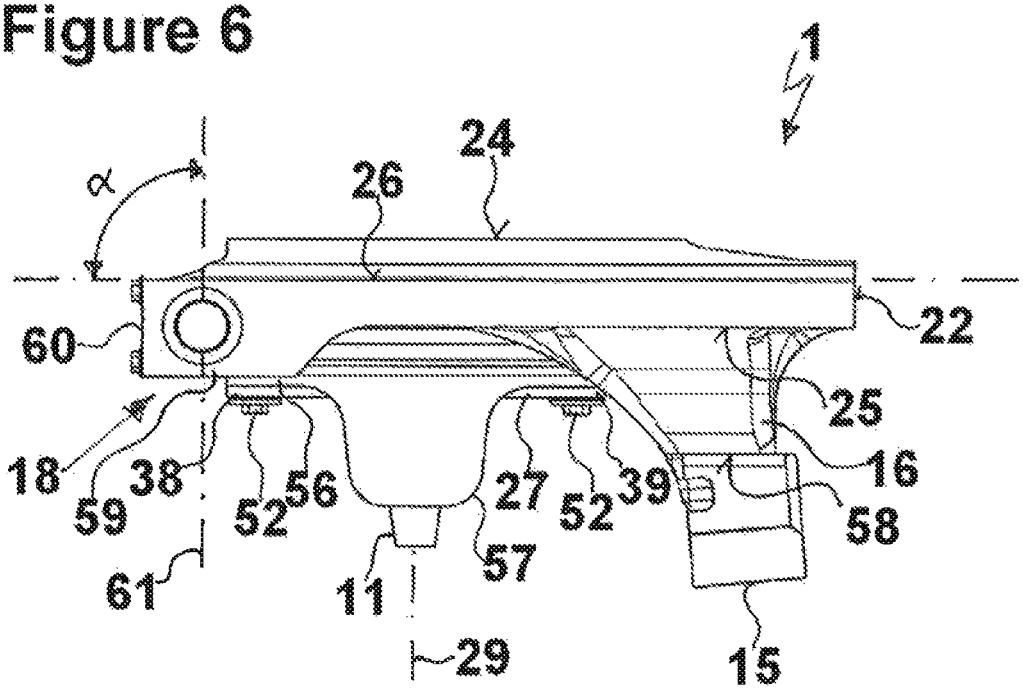
FIG. 6 shows a side view of the cross member illustrated in FIG. 2.
Figure 7:
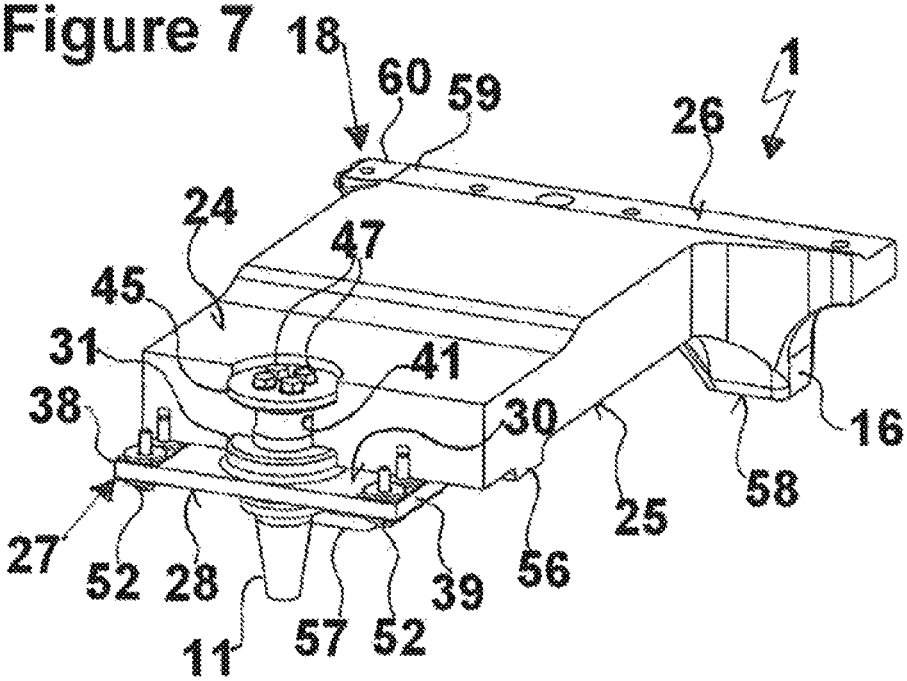
FIG. 7 shows an oblique view of the cross member cut in its transverse axis, according to FIG. 2.
Figure 8:
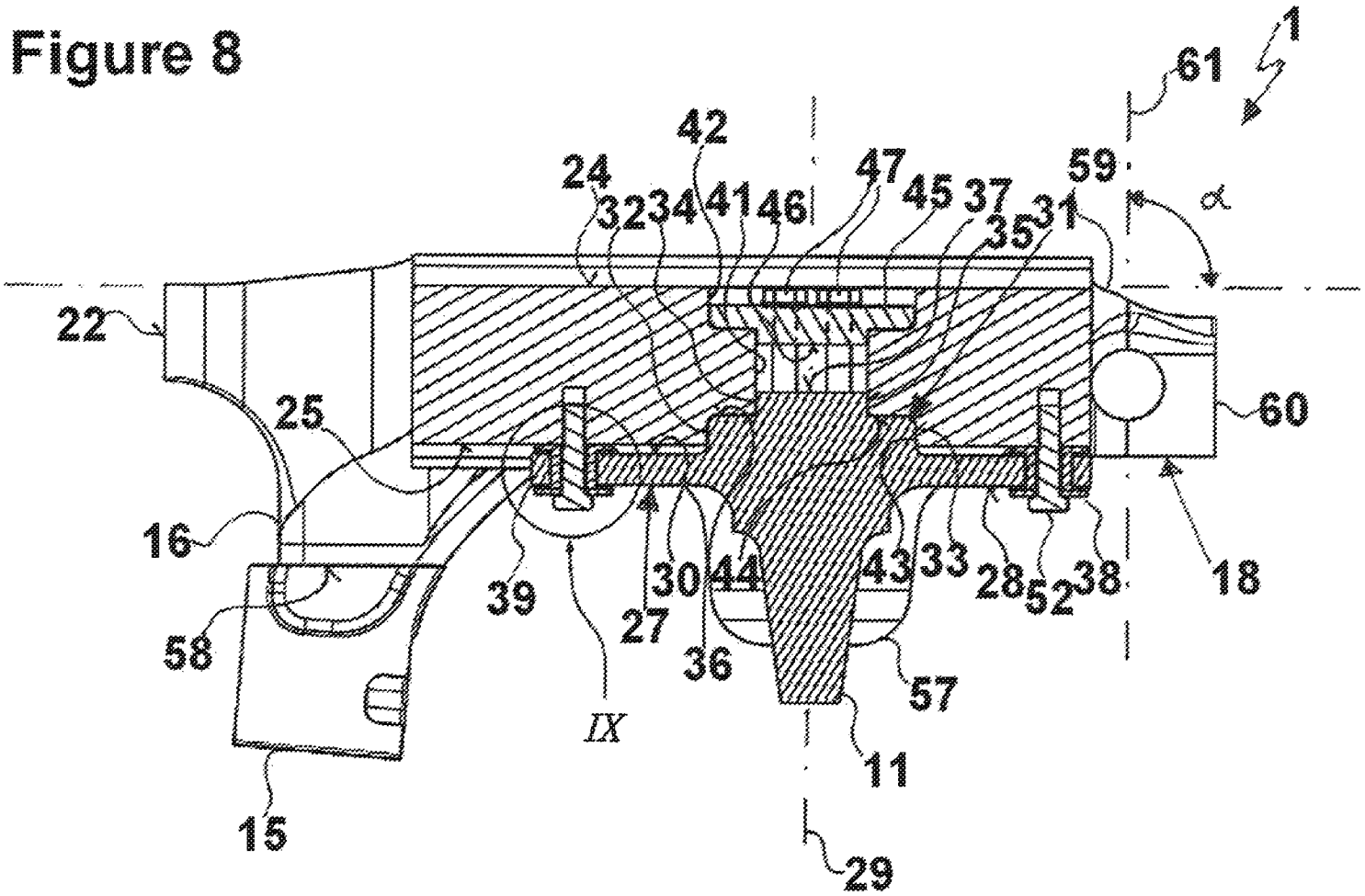
FIG. 8 shows a cross-sectional view of a cross member according to the invention along the transverse axis on a larger scale.

Ways of Working the Invention and Commercial Usability:

FIG. 1 shows the end region of a rail vehicle 2 equipped with cross member 1 according to the invention, which in the present example is formed by a non-driven car. The rail vehicle 2 comprises a carriage body 3, which is indicated by dashed lines, on whose underside, which may be formed by an undercarriage, a cross member 1 according to the invention is fixed rigidly. The concrete embodiment of the cross member 1 according to the invention is the subject matter of FIGS. 2 to 10.

Further, FIG. 1 shows a running gear, configured as bogie 4, with two wheel sets 5, which are braced on the bogie frame 7 by means of guide rods 6 and are held by a primary suspension. The bogie frame 7 has two longitudinal beams 8, which are rigidly connected to each other via end-carriage 9. Between the end-carriages 8 the bogie frame 7 has a lowered region, where a rubber-bellows-shaped air spring 9 is located to the centre of the bogie, respectively and a pivot pin socket are located lateral to the centre of the bogie. The air springs 9 form the main suspension of the rail vehicle 2 and are connected directly to the central air supply of the rail vehicle 2 via the cross member 1.

The linking of the carriage body 3 to the bogie 4 is such that a pivot pin 11 extending centrally from the underside of the cross member 1 in the direction of the bogie 4 engages in the pivot pin socket on the bogie 4, in order to be able to transfer the braking and tensile forces between the bogie 4 and the vehicle body 3, without having to hinder the relative movements in the form of turning, lifting, lowering, tilting and rolling movements.

In order to dampen the relative movements mentioned between the bogie 4 and the carriage body 3, as shown in FIG. 1, winder damper 12 and roll damper 13 are arranged on both sides of the bogie 4, respectively. With their one end, both the winder damper 12 and roll damper 13 are hinged, in each case, to a bracket 14 disposed on the outer side of the longitudinal support 8 of the bogie frame 7. The other end of the winder damper 12 is hinged to a winder damper head 15, which is fixed on a winder damper bracket 16 protruding from the underside of the cross member 1.

The two roll dampers 13 are linked by means of a roll bearing rod 17, the ends of which are supported on both sides in roll bearings 18 fixed on the cross member 1. The connection between the roll bearing rod 17 and the roll dampers 13 is done in each case via a rotary lever 19, which sits torque-proof on the roll bearing rod 17 and the roll damper 23 is connected to its free end.

In the case of such a connection of a carriage body 3 to a bogie 4, braking and pulling forces are thus introduced into the bogie 4 via the pivot pin 11, forces from a lifting and lowering movement via the air springs 10, forces from a rolling movement via the roll dampers 13 and forces from a rolling movement via the winder dampers 14.

The precise setup of a cross member 1 according to the invention is shown in FIGS. 2 to 10, wherein the same features apply to the same reference symbols in all diagrams, even if these are not expressly described under individual figures.

The cross member 1 has a longitudinal axis 20 and a transverse axis 21 running perpendicular thereto. The transverse longitudinal sides 22 run parallel to the longitudinal axis 20, the cross-member transverse sides 23 parallel to the transverse axis 21. The upper side assigned to the carriage body 3 bears the reference numeral 24, the lower side facing the bogie 4 bears the reference numeral 25. On the upper side 24, the cross-member transverse sides 23 each have a fastening surface 26 for rigid connection to the carriage body 3. On the other hand, the components for the hinged connection to the bogie 4 are arranged on the underside 25. Inside, a cross member 1 according to the invention has a pressure-tight cavity, which is penetrated by a multiplicity of reinforcing ribs. The partial cavities between the reinforcing ribs are interconnected, thus forming a communicating system so that the air can flow through the entire cavity of the cross member 1.

A first subassembly for transmitting the braking and pulling forces comprises a rectangular pivot pin plate 27 made of steel, whose pivot pin 11 protrudes centrally and monolithically from the underside 28 of the latter, whose axis is designated with 29. The pivot pin 11 has a conical shape, which tapers towards the free end, with which it engages in the pivot pin socket on the bogie 4. As can be particularly seen from FIG. 8, the opposing upper side 30 of the pivot plate 27 has a coaxial attachment 31, which protrudes monolithically from the pivot pin plate 27. The attachment 31 is stepped with a first longitudinal section 32 of larger diameter, to which a first circumferential surface 33 is assigned, and with a second longitudinal section 43 of smaller diameter with a second peripheral surface 35. The radial offset between the first circumferential surface 33 and the second circumferential surface 35 creates a ring attachment 36 on the attachment 31. In the end face 37 of the attachment 31, four axis-parallel threaded bores are inserted on a circumferential circle concentric to the pivot pin axis 29, with a uniform peripheral distance and a narrow radial distance from the axis 29, and engage in the clamping screws 47, described later. The regions of the pivot pin plate 27 which are diametrically opposite the pivot pin 11 or the attachment 31 form the fastening sections 38 and 39, in the edge region of which in each case three bores 40 are arranged for receiving the fastening means.

For form-close mount of the pivot plate 27, the cross member 1 has a circular cylindrical clamping channel 41 extending from the upper side 24 to the lower side 25, whose inner diameter corresponds to the outer diameter of the second longitudinal section 34 of the attachment 31. In the immediate vicinity of the upper side 24 and the lower side 25, the clamping channel 41 widens to a larger diameter and thus forms a cylindrical expanded first longitudinal section 42 and second longitudinal section 43. In the region of the expanded second longitudinal section 43, the inner diameter corresponds to the outer diameter of the first longitudinal section 38 of the attachment 31, so that the pivot pin plate 27 with its attachment 31 is positively engaged by the clamping channel 41, taking into account the thermal expansion. Thereby, the annular collar 36 of the attachment 31 rests against the cross member 1, under contact to an annular bearing surface 43, formed by the radial setback of the expanded second longitudinal section 43. A play-free bearing on the annular bearing surface 43 is ensured by the fact that the first longitudinal section 32 of the attachment 31 has a larger axial extent than the expanded second longitudinal section 43, which leads to the fastening sections 38 and 39 of the pivot pin plate 27 with a slight clear distance from the underside 25 of the cross member 1.

The widened first longitudinal section 42 of the cross member 1 helps the form-fit mount of a complementarily formed abutment plate 45, which extends with a stump-shaped coaxial attachment 46 on its underside into the tensioning channel 41. The abutment plate 45 has through-holes, whose hole pattern corresponds to that of the threaded bores in the end face 37 of the attachment 1. Using the clamping screws 47, which are grouped in a narrow radial distance within the clamping channel 41 around the pivot pin axis 29 and are supported by their screw heads on the abutment plate 45, the pivot plate 27 is tightened against the cross member 1.

Such a connection of the pivot pin plate 27 to the cross member 1 concentrates the force transmission region on a small region around the pivot pin axis 29, whereby the forces in the driving mode are transferred to the cross member 1, transverse to the pivot pin axis 29 through the form closure by the first circumferential surface 33 and second circumferential surface 35, and forces in the direction of the pivot pin axis 29 are absorbed by the annular bearing surface 44 or the threaded bolts 47.

The relative position of the pivot pin plate 27 to the cross member 1 is such that the fastening sections 38 and 39 are aligned in the transverse axis 21 of the cross member 1. This has the advantage that the fastening sections 38 and 39 contribute to the force transmission in the case of extraordinary shock loads, for example, during an impact or accident. In order to prevent damage to the pivot pin plate 27 as a result of high special loads, even under the conditions of low temperature factors, the fastening sections 38, 39 are fastened floatingly to the cross member 1, which means that a support of the fastening sections 38, 39 is perpendicular to the underside 25 of the cross member 1, while relative movements of the pivot pin plate 27 opposite the cross member 1 are possible in the plane of the underside 25.

Figure 9:
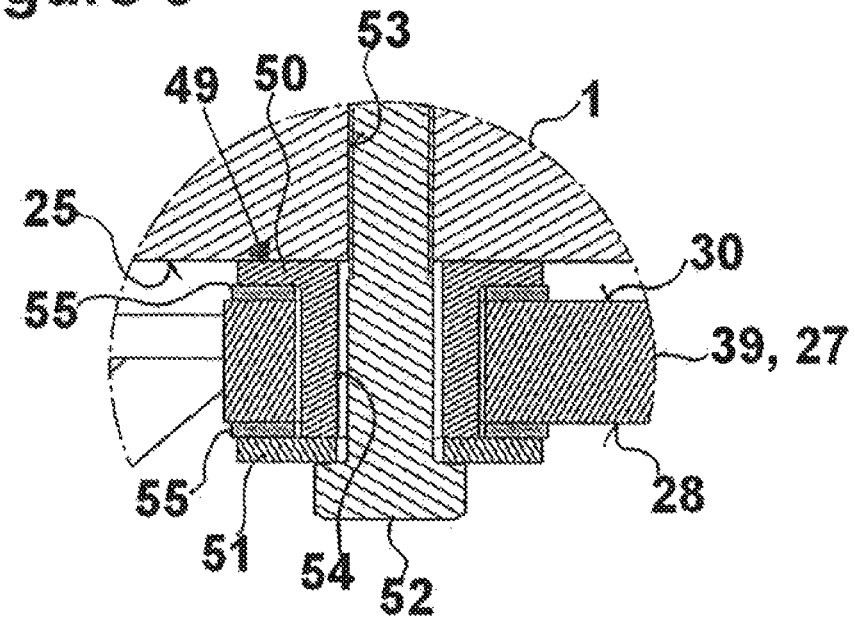
FIG. 9 shows a detail of the region indicated by IX in FIG. 8.
Figure 10:
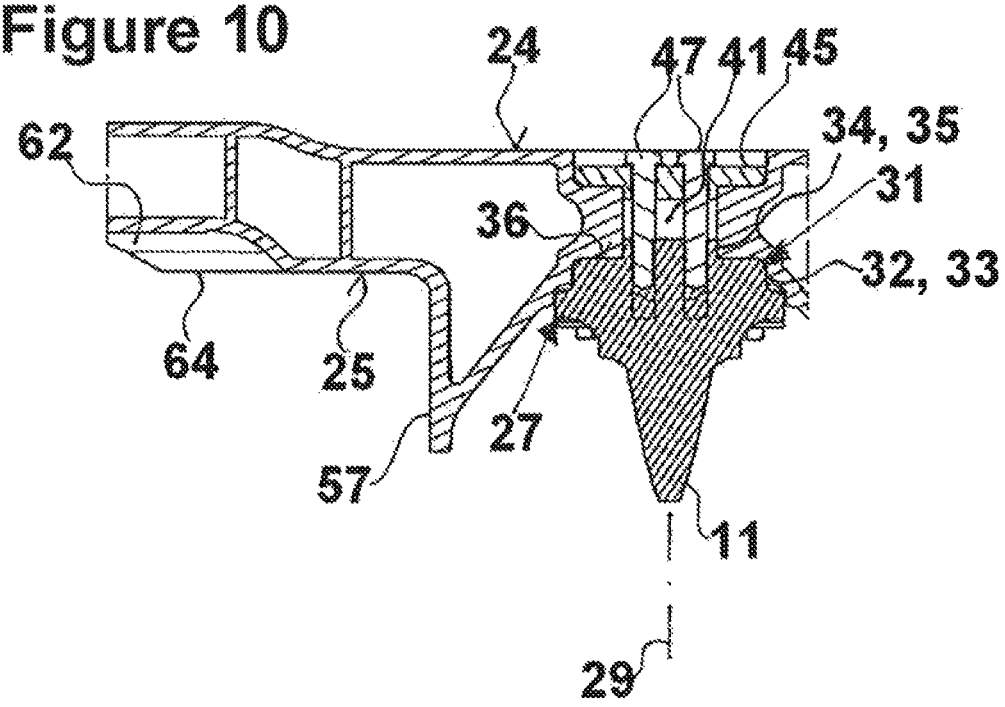
FIG. 10 shows a partial section through a cross-member according to the invention along the line indicated with X-X in FIG. 5.

As can be seen especially from FIG. 9, the fastening sections 38 and 39 have a number of slightly-shaped oblong holes 48, whose longitudinal direction extends into the displacement direction. The oblong holes 48 are provided with spacer bushings 49, whose flanges 50 come to lie in the clear distance between the fastening sections 38, 39 and the underside 25 of the cross member 1. With the interposition of a flat washer 51, a screw 52 penetrates the flange bushings 49 and engages in one threaded bore 53 on the underside of the cross member 1. The shaft 54 of the flange bushing 49 is slightly longer than the thickness of the fastening sections 38, 39. In the overhang of the flange 50, so formed, and the flat washer 51 to the fastening sections 38, 39, a sliding layer 55 is inserted.

On both sides of the pivot pin plate 27, skirting boards 56 run parallel to the transverse axis 21 of the cross member 1. The skirting boards 56 extend monolithically from the underside 25 of the cross member 1 and include the pivot pin plate 27 in a positive-locking manner in the space formed in between (FIGS. 2, 3, 4 and 10).

In the middle region of the skirting boards 56 at the level of the pivot pin 11, a side stop 57 is in each case cast monolithically on the skirting board 56. The two side stops 57 are thus extended on both sides of the pivot pin 11 and run parallel to this from the underside 25 of the cross member 1 and are ran thus separated from the pivot pin plate 27. As is particularly evident from FIG. 10, the side stops 57 are likewise configured as hollow body as the cross member 1, whereby the cavities merge.

In the area of the two transverse sides 23, at the underside 25 of cross member 1 one winder damper bracket 16 each is cast, with a wide base that tapers towards the free end and a flat bearing surface 58 is available there for mounting a winder damper head 15. The winder damper bracket 16 is designed similar to the side stop 57 as a hollow body, whereby the cavity of the cross member 1 and the cavity of the winder damper bracket 16 merge again into each other and result in a total void.

At the ends of the cross-member transverse sides 23 opposite the winder damper brackets 16, a roll bearing 18 is arranged in each case, in which one end of the roll bearing rod 17 is pivoted. The roll bearing 18 is divided and includes an attachment 59 cast onto the cross member 1 with a first bearing surface, and a loose bearing shell 60 with a second bearing surface, which is stretched for forming the roll bearing 18 by means of screws against the attachment 59. It can be seen from FIG. 6 that the plane 61 of the joining surfaces runs at an angle $\alpha$ to the plane formed by the cross member 1. In the present embodiment, the angle $\alpha$ amounts to 90°, but can lie in a range between 60° and 120°.

The cross member regions between the side stops 57 and the winder damper bracket 16 and roll bearing 18 form the respective bearing surfaces 62 for the air springs 10. The bearing surfaces 62 have a circular shape and are provided with port openings 63 to the cavity of the cross member 1. The area of the cross member 1 lying between the bearing surfaces 62 is designed raised relative to the bearing surfaces 62, whereby a border 64 of the bearing surfaces 62 is formed. Inside the cross member 1 the raised regions lead to a cavity enlargement.

The invention claimed is:

1. A cross member for linking a carriage body of a rail vehicle on a bogie thereof comprising a cross member body having an upper side configured to connect to the carriage body, and an underside having a pivot plate with pivot pins, said pivot pins secured on the underside of the cross member body using fastening members, whereby the pivot pin is configured to be flexibly mounted in a pivot pin socket on the bogie for transmitting tensile and braking forces, the pivot plate having, on its upper side facing away from the pivot pin, an attachment running coaxial to a longitudinal axis of the pivot pin, and the cross member body having, on its underside facing the pivot plate, a complementary recess to the attachment, into which the pivot plate is insertable axially with the attachment, and second fastening members are provided for tensioning the pivot pin plate against the cross member in an axially parallel position about the longitudinal axis of the pivot pin and are anchored with one end in an end face of the attachment.

2. The cross member according to claim 1, wherein the attachment is stepped with a first longitudinal section having a first circumferential surface and at least a second longitudinal section with a second circumferential surface, the first circumferential surface and the second circumferential surface are connected via an annular collar running normal to the longitudinal axis.

3. The cross member according to claim 1, wherein the cross member body has a clamping channel extending from the upper side of the cross member body to the complementary recess on the underside of the cross member body , and the second fastening members are anchored at a second end in an abutment plate which is supported on the upper side of the cross member body.

4. The cross member according to claim 3, wherein the cross member body has a second recess complementary to the abutment plate in the region of the abutment plate on its upper side.

5. The cross member according to claim 1, wherein the second fastening members are located within a circumferential circle about the longitudinal axis, the diameter of circumferential circle has a maximum of 100 mm.

6. The cross member according to claim 1 wherein the pivot pin plate has fastening sections, which are diametrically opposite the longitudinal axis, for providing support on the cross member body.

7. The cross member according to claim 6, wherein the pivot pin plate is arranged on the underside of the cross member body such that the diametrically opposite fastening sections, lie in the region of a cross-member longitudinal side.

8. The cross member according to claim 6, wherein the fastening sections are float-mounted on the cross member body using third fastening members, wherein the third fastening members hold the fastening sections perpendicular to a plane of the pivot pin plate and allow movements in the plane of the pivot pin plate.

9. The cross member according to claim 6, wherein the third fastening members include at least one screw, which passes through one of the fastening sections with play in the plane of the pivot pin plate.

10. The cross member according to claim 9, wherein the at least one screw is held in a spacer bushing, wherein the spacer bushing is guided in a sliding bearing opposite the fastening sections.

11. The cross member according to claim 1, wherein the cross member body has two strip-shaped pedestals running parallel to each other in a transverse direction of the cross member body on its underside, and the pivot plate is form-fit incorporated between the two strip-shaped pedestals.

12. A cross member for linking a carriage body of a rail vehicle to a bogie, comprising a cross member body having an upper side configured to be connected to the carriage body, and an underside having a pivot pin plate with a pivot pin, the pivot pin plate having, on its upper side facing away from the pivot pin an attachment running coaxial to a longitudinal axis of the pivot pin, whereby the pivot pin is configured to be movably mounted for transmitting the tensile and braking forces in a pivot pin socket on the bogie, the cross member body further comprising at least a bracket protruding from the underside and configured for linking a winder damper that is active between bogie and the cross member body, which is determined for including a winder damper head coupled with the winder damper, and/or wherein the cross member has at least one side stop protruding from the underside for guiding the bogie, characterized in that the at least one bracket and/or the at least one side stop are cast monolithically on the cross member body.

13. The cross member according to claim 12, wherein the cross member body and the at least one bracket or the at least one side stop are hollow bodies, and the cross member body and the at least one bracket or the at least one side stop form a total cavity or a communicating cavity system.

14. The cross member according to claim 12, wherein a free end of the at least one bracket has a bearing surface for fastening the winder damper head.

15. A cross member for linking a carriage body of a rail vehicle at the bogie (4) thereof comprising a cross member body having an upper side configured to be connected to the carriage body and an underside , the underside having a pivot pin plate with pivot pin attached thereto, the pivot pin plate having, on its upper side facing away from the pivot pin, an attachment running coaxial to a longitudinal axis of the pivot pin, wherein the pivot pin is movably mounted for transmitting traction and braking forces in a pivot pin socket at the bogie, and the cross member body has at least one roll bearing for a winder damper active between the bogie and the cross member body , the cross member body includes a roll bearing rod coupled with the winder damper, wherein the roll bearing comprises an attachment disposed at the cross member body and a bearing shell that is connectable in a connecting plane with the attachment, the connecting plane runs at an angle a to a plane of the cross member body, wherein the angle a lies in a range from 60° to 120°.

16. The cross member according to claim 15, wherein the angle $\alpha$ is 90°.

17. The cross member according to claim 15 wherein the attachment protrudes monolithically from the cross member.

18. A cross member for linking a carriage body of a rail vehicle on a bogie thereof, comprising a cross member body, wherein an upper side of the cross member is connected to the carriage body, and on the underside of the cross member a pivot pin plate is secured with pivot pin, the pivot pin plate having, on its upper side facing away from the pivot pin, an attachment running coaxial to a longitudinal axis of the pivot pin, whereby the pivot pin is movably mounted for transmitting tensile and braking forces in a pivot pin socket on the bogie, and whereby bearing surfaces , lateral to the pivot pin plate, are provided for main suspension, and whereby the cross member body is designed as a hollow body, characterized in that at least an area of the cross member body lying between the bearing surfaces is recessed opposite the bearing surfaces, whereby the bearing surfaces lie in recesses for a main suspension and a hollow space of the hollow body in the recessed area has a greater clear height between the upper side and the lower side underside of the cross member body than in the region of the bearing surfaces.

19. The cross member according to claim 18, wherein the bearing surfaces are of circular design and the recessed region extends over at least one quarter the circumference of the bearing surfaces.

20. The cross member according to claim 18, wherein the height of the recessed area perpendicular to the bearing surfaces amounts to at least 30 mm.

* * * * *